United States Patent [19]

Vaupotic et al.

[11] Patent Number: 5,015,800

[45] Date of Patent: May 14, 1991

[54] MINIATURE CONTROLLED-IMPEDANCE TRANSMISSION LINE CABLE AND METHOD OF MANUFACTURE

[75] Inventors: Gregory P. Vaupotic, Portland; Doris A. Beck, Beaverton; Sokha Chy, Tualatin, all of Oreg.

[73] Assignee: SuperComputer Systems Limited Partnership, Eau Claire, Wis.

[21] Appl. No.: 454,022

[22] Filed: Dec. 20, 1989

[51] Int. Cl.[5] ..... H01B 11/00

[52] U.S. Cl. ..... 174/34; 156/51; 174/36; 174/117 F

[58] Field of Search ..... 174/34, 36, 117 F; 156/51

[56] References Cited

U.S. PATENT DOCUMENTS

| | | | |
|---|---|---|---|
| 3,005,739 | 10/1961 | Lang et al. | 156/51 X |
| 3,649,434 | 3/1972 | Mortenson | 174/117 F X |
| 4,131,690 | 12/1978 | Jukes et al. | 174/120 R X |
| 4,218,581 | 8/1980 | Suzuki | 174/117 F |
| 4,234,759 | 11/1980 | Harlow | 174/104 |
| 4,368,214 | 1/1983 | Gillette | 174/117 F X |
| 4,468,089 | 8/1984 | Brorein | 174/36 X |
| 4,481,379 | 11/1984 | Bolick, Jr. et al. | 174/117 F X |
| 4,515,993 | 5/1985 | MacKenzie | 174/102 R |
| 4,541,980 | 9/1985 | Kiersarsky et al. | 264/174 |
| 4,697,051 | 9/1987 | Beggs et al. | 174/34 X |
| 4,755,629 | 7/1988 | Beggs et al. | 174/34 |

FOREIGN PATENT DOCUMENTS

| | | | |
|---|---|---|---|
| 68987 | 6/1977 | Japan | 174/117 F |
| 441458 | 1/1968 | Switzerland | 174/117 F |
| 1390152 | 4/1975 | United Kingdom | 174/117 F |

*Primary Examiner*—Morris H. Nimmo

*Attorney, Agent, or Firm*—Chernoff, Vilhauer, McClung & Stenzel

[57] ABSTRACT

A miniature controlled-impedance transmission line consists of a flexible cable having side-by-side conductors transmitting high frequency signals. The cable is preferably in the form of a pair of conductors, each surrounded by respective inner and outer dielectric layers of different compositions. The inner and outer dielectric layers are applied to each conductor independently of the other conductor, after which the respective outer dielectric layers of the two conductors are bonded together in side-by-side relationship without altering the inner dielectric layers. The result is a conductor pair having minimum cross-section for high-density applications and uniform capacitance which is also stable in that it will not change with subsequent bending or handling. Preferably, the conductors, with their inner and outer dielectrics, are helically twisted together prior to bonding so that the bonding forms a permanently twisted pair having not only uniform and stable capacitance but also uniform and stable lay length with resultant uniform electrical delay characteristics of both conductors.

13 Claims, 1 Drawing Sheet

MINIATURE CONTROLLED-IMPEDANCE TRANSMISSION LINE CABLE AND METHOD OF MANUFACTURE

BACKGROUND OF THE INVENTION

The present invention relates to miniature, flexible, controlled-impedance transmission line cables comprising an elongate pair of transversely separated, side-by-side conductors for transmitting high-frequency signals in computer and other comparable applications.

Electrical conductor pairs suitable for the transmission of high-frequency signals must have a number of critical characteristics which are not important for conductors used for lower frequency transmissions. These characteristics include reliable uniformity of transverse spacing between the conductors, and uniformity of dielectric constant in the regions transversely separating the conductors, so that capacitance between the conductors is reliably predictable.

Moreover, the lengths of the two conductors, and their resultant delays, must be identical so that the signals carried by the respective conductors arrive at their destinations in synchronization. Since such conductor pairs are often twisted helically to resist adverse effects of external magnetic fields, achieving equal electrical length of the conductors requires that the respective helical twists have a uniform length, referred to as "lay length"; otherwise, when cutting a twisted pair of conductors to a desired length, one conductor may be longer than the other even though they are cut to length in unison.

Moreover, the foregoing uniform parameters must remain stable despite subsequent bending or other handling of the conductors during manufacture, operation, and servicing of the equipment. While one might assume that this can readily be accomplished simply by fastening the conductors together in a common outer jacket, this step has presented numerous problems in practice. One problem is the significant increase in cross-sectional area of the conductor pair required to encase it in such a jacket. The cross-sectional area of the conductor pair is increased markedly if a common external jacket is applied to the pair of conductors by extrusion or other means. Such increase in cross-sectional are constitutes a serious disadvantage in attempting to use conductor pairs in high-density applications where literally thousands of such conductor pairs must extend side-by-side within limited confines and be terminated at correspondingly high-density connectors. Moreover, the capacitance and thus characteristic impedance of the conductor pair can be rendered nonuniform by the application of a common outer jacket to the two conductors, particularly by the inadvertent creation of air voids in the region surrounding the two conductors. Even an outer jacket extrusion process, when applied to a pair of side-by-side conductors, cannot reliably fill in all voids surrounding the conductors. Such air voids become a particularly severe problem in equipment where the conductor pairs are immersed in a liquid, such as the coolant fluorinert. Ultimately, such fluid finds its way into such air voids, creating a stability problem because a substantial time period may be required for the liquid to completely fill the voids. Moreover, the cable is periodically separated from the fluid for purposes of servicing or replacing components, causing the liquid to drain, evaporate or diffuse from the voids. Thereafter, when the cable is once more immersed in the liquid, a substantial time period may be required for the liquid to refill the voids and become stable. In the meantime, an unstable period of changing dielectric constants an resultant changing impedances may render the system inoperable.

Alternatively, attempting to dispense with the common outer jacket by bonding respective dielectric layers, immediately surrounding the respective conductors, directly to each other is unsatisfactory because the preferred dielectrics, such as FEP or PTFE, are very difficult to bond reliably with adhesives or solvents. Conversely, if heat bonding is utilized, the dielectric layers would be altered by such bonding at least dimensionally, and in some cases also with respect to their dielectric constants, thereby making it difficult to controllably predetermine the electrical characteristics of the resulting conductor pair.

Many examples of multiple, interconnected electrical conductors and their methods of manufacture exist in the prior art, such as those shown in the following U.S. Pat. Nos.:

3,649,434
4,131,690
4,218,581
4,234,759
4,368,214
4,468,089
4,515,993
4,541,980

However, none of these suggests a solution to any of the foregoing problems of miniature controlled-impedance transmission lines having transversely separated side-by-side conductors.

SUMMARY OF THE INVENTION

The present invention solves the above-identified problems by means of a unique method of manufacture, and a resultant unique structure, of a miniature controlled-impedance transmission line conductor pair (as used herein, "pair" includes two or more conductors). In accordance with the invention, each of the respective conductors is surrounded by an inner and an outer dielectric layer independently of the other conductor, the inner layer being of a different composition than the outer layer so as to be unaffected structurally or dimensionally by a subsequent step wherein the outer dielectric layers are bonded to each other in side-by-side relationship. The bonding is accomplished by forcibly abutting the two outer dielectric layers against each other in side-by-side relationship, preferably by helically twisting the two conductors together, and then bonding the two outer dielectric layers together without altering either the dimensional or dielectric constant characteristics of the inner dielectric layers. Preferably, the bonding is accomplished by passing the conductors, with their outer dielectric layers in abutment, through a sintering furnace to heat the outer dielectric layers and fuse them together, the inner layers having a higher melting point than the outer layers so as to be unaffected by the heat of fusion. Alternatively, bonding could be accomplished by passing the conductors through a bath composed of a solvent or adhesive compatible with the outer, but not the inner, dielectric layers, thereby fusing or adhering the outer layers together without altering the inner layers. In any case, although the outer dielectric layers are altered by the bonding process, the inner dielectric layers are unaffected despite inadvertent or uncontrollable variables in the bonding process, such as temperature variations. Thus, the inner dielectric layers substantially predetermine both the minimum transverse spacing of the conductors and the effective dielectric constant between the conductors, despite uncontrollable manufacturing variations in the bonding step. Accordingly, the finished bonded conductor pair resulting from the foregoing method has uniformity of transverse spacing and dielectric constant in the region separating the pair of conductors, and therefore reliably uniform capacitance.

Moreover, such uniformity is stable in that the bonding of the outer dielectric layers produces no air voids in the region between the conductors, and particularly none which could be invaded by a liquid if the conductors are immersed. Thus, the dielectric constant in the region separating the conductors remains substantially unchanged in use.

Furthermore, uniformity of electrical length, and thus of delay, of the respective conductors is ensured, particularly in the case of a helically-twisted pair since stability of the lay length is provided by the bonding of the outer dielectric layers.

Moreover, crosstalk is minimized because the respective conductors cannot separate.

Finally, the cross-sectional area of the conductor pair is significantly less than could be obtained by encasing the conductors in a common outer jacket, thereby optimizing the conductor pair for high-density applications.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
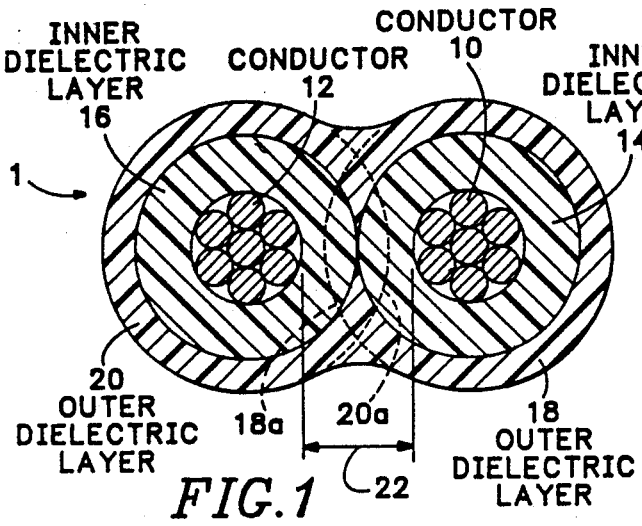
FIG. 1 is a cross section of an exemplary embodiment of a conductor pair manufactured in accordance with the method of the present invention.

With reference to FIG. 1, an exemplary embodiment of a miniature controlled-impedance transmission line 1, constructed in accordance with the present invention, comprises a pair of side-by-side, seven-strand 32AWG copper alloy conductors 10 and 12, each surrounded by an inner dielectric layer 14 and 16, respectively, preferably of an extruded polymeric fluorocarbon such as TEFLON ® FEP of approximately 0.0045 inch wall thickness. Surrounding the inner dielectric layers 14 and 16 are respective outer dielectric layers 18 and 20 which, although initially applied to each inner dielectric layer independently as indicated by their original surface contours 18*a* and 20*a*, have subsequently been fused together by heating in accordance with the method described hereafter to form the conductor pair depicted in FIG. 1. The outer dielectric layers 18 and 20 are of a different composition than the inner dielectric layers 14 and 16, being composed for example of polypropylene having an initially extruded wall thickness of approximately 0.0025 inch and a melting point (about 375° F.) significantly lower than that of the FEP inner dielectric layers 14 and 16 (about 465° F.). Although, as depicted in FIG. 1, the surfaces of the inner dielectric layers 14 and 16 have been brought into close proximity with each other by the bonding process, they could alternatively be spaced further apart. The spacing depends upon the degree of fusion of the outer dielectric layers 18 and 20, which in turn is dependent upon the dwell time and temperature of the sintering furnace which fuses them together.

Because the inner dielectric layers 14 and 16, due to their higher melting point, can remain both structurally and dimensionally unaffected by the heat of the fusion process, they reliably limit the minimum transverse spacing 22 (FIG. 1) between the respective conductors 10 and 12 and, in the case of air-enhanced dielectrics, limit the maximum effective dielectric constant, regardless of other variables which may occur uncontrollably in the fusion process. Such limits, in turn, reliably predetermine the capacitance between the conductors, which is critical to insure relatively uniform characteristic impedance of the two-conductor transmission line.

Figure 2:
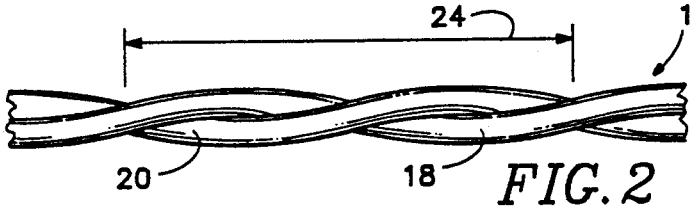
FIG. 2 is an exemplary helically-twisted embodiment of a conductor pair in accordance with the present invention.

The conductor pair of FIG. 1 is preferably a helically-twisted pair as shown in side view in FIG. 2. In such case, the twisting is performed prior to fusion of the outer dielectric layers, the conductor pair after fusion thereby assuming a permanent helically-twisted shape having a uniform lay length 24 which, together with the transverse spacing of the conductors 10 and 12, remains stable and unchanged through subsequent bending or other handling of the conductor pair. The uniform lay length, in turn, ensures equality of electrical length of the two conductors 10 and 12 when the conductor pair is subsequently cut to a predetermined length for incorporation in a computer or other electronic product. This ensures that the electrical delay of both conductors is equal and that signals traveling along the conductors are thus synchronized within the demanding tolerances required for the transmission of high-frequency signals. However, it should be understood that the conductor pair need not be helically twisted but can alternatively extend in parallel, side-by-side relation to each other.

It is particularly important that no air voids be formed in the outer dielectric material in the region of joinder between the conductors 10 and 12. The absence of such air voids is ensured by initially applying the outer dielectric layers 18 and 20 independently around each conductor, followed by abutting and bonding the outer dielectric layers to each other. Such process creates an area of joinder between the outer dielectric layers which expands outwardly from the crevice at their initial point of abutment, allowing air to escape outwardly as the bonding occurs. In contrast, absence of air voids cannot be ensured if an outer dielectric jacket is applied to a pair of side-by-side conductors in unison by extrusion around the conductor pair, because in that case the area of joinder expands inwardly toward the crevice between the conductors, tending to trap air therein.

Moreover, with respect to the cross sectional area of the finished conductor pair, if the outer dielectric had been extruded onto both conductors in unison, excess outer dielectric material would normally have been deposited on the upper and lower sides of the structure of FIG. 1 to guarantee the achievement of the minimum necessary wall thickness of the outer dielectric at the points of maximum transverse dimension of the conductor pair, i.e. at the right and left edges of the cross-section of FIG. 1. This, however, would have made the resultant cross section of significantly greater area than that shown in FIG. 1, hindering the use of the conductor pair in high-density applications.

Figure 3:
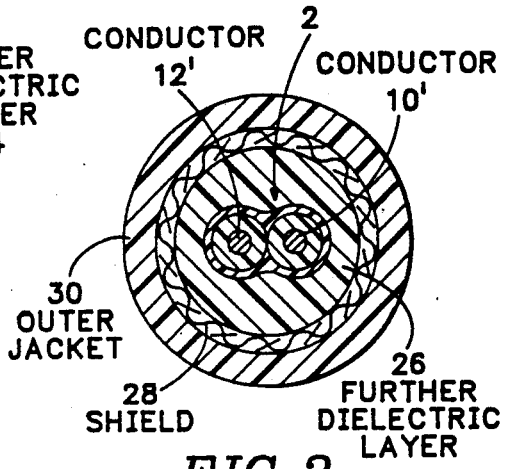
FIG. 3 is a further embodiment of the present invention wherein a conductor pair is incorporated into a shielded cable.

FIG. 3 shows a further embodiment of the invention having a miniature controlled-impedance transmission line 2 which may be either twisted or untwisted, and which is similar in all respects to the transmission line 1 of FIG. 1 except that the conductors 10' and 12' are solid rather than stranded conductors. The transmission line conductor pair 2 is surrounded by a further extruded dielectric layer 26 preferably composed of low-density polyethylene having an outside diameter of approximately 0.061 inch. Surrounding the dielectric layer 26 is a braided wire shield 28, preferably providing in the range of 80% to 90% coverage of the dielectric layer 26. The shield 28 in turn is surrounded by, and penetrated by, a polypropylene exterior jacket 30 to exclude as much air as possible from the braided shield and from the shield's interface with the underlying dielectric 26 to minimize air voids for the reasons previously discussed. The 80% to 90% coverage facilitates the penetration of the polypropylene through the shield. Preferably, the jacket 30 has a wall thickness of approximately 0.009 inch. The shielded transmission line 2 is suitable for more demanding high-frequency usage where protection from interfering external electrical fields is needed to ensure the reliability of the transmissions, for example in an oscillator or "clock" circuit which provides overall system timing in a computer. In this application, the bonded outer dielectric layers 18 and 20 not only prevent air voids in the region between the conductors 10' and 12', but also prevent the formation of air voids in the dielectric layer 26, when it is extruded around them, by eliminating any deep crevice between the conductors in which air could be trapped during the extrusion of the dielectric layer 26. Again, the prevention of air voids is particularly critical in situations where the transmission line is to be immersed in a liquid, for reasons already described.

Figure 4:
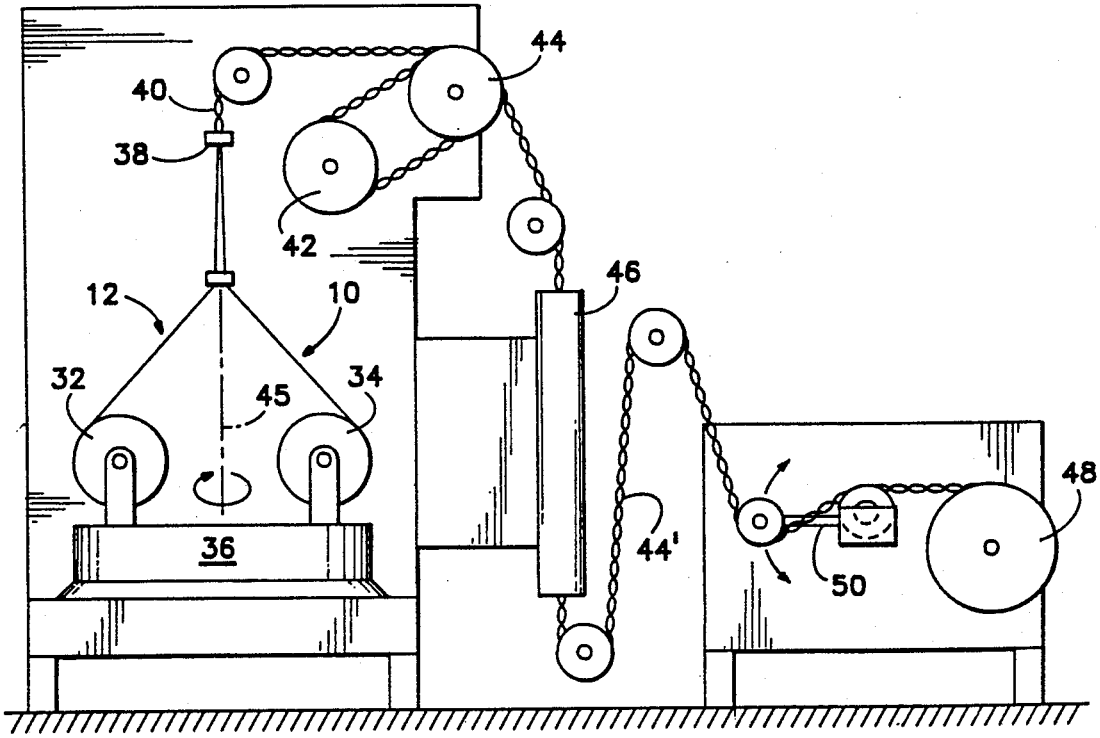
FIG. 4 is a schematic diagram depicting the preferred method of manufacture in accordance with the present invention.

The method of manufacture of the conductor pairs 1 or 2 comprises forming the respective inner dielectric layers 14, 16 around the respective conductors 10, 12 or 10', 12' separately, and thereafter likewise separately forming the respective outer dielectric layers 18, 20 around the respective inner dielectric layers 14, 16. The inner and outer dielectric layers are applied to each separate conductor by conventional extruding techniques well-known to the art. Thereafter, with reference to FIG. 4, each conductor such as 10, 12, with its inner and outer dielectric layers applied, is wound onto a respective reel 32, 34 of a conventional wire-twisting machine 36. The conductors are fed through a die 38 so that the resultant twisted pair 40 is wrapped around driving drums 42, 44 which pull the conductors 10, 12 from the reels 32, 34 at a predetermined speed while the machine rotates the reels 32, 34 about an axis 45 at a predetermined rotational speed, thereby determining the lay length 24 (FIG. 2) of the twisted pair. From the driving drums 42, 44, the twisted pair is fed through a vertical sintering oven 46 having a temperature and dwell time sufficient to melt, or at least highly plasticize, the outer dielectric layers 18, 20 without thereby melting the inner dielectric layers 14, 16 which have a higher melting point. Since the twisting of the conductors by the twisting machine 36 has forcibly abutted the outer dielectric layers 18, 20 against each other, the passage of the twisted pair through the oven 46 fusibly bonds the abutting portions of the outer dielectric layers together into a configuration such as that shown in FIG. 1. As the twisted pair emerges from the oven 46 it cools, resulting in a permanently helically-twisted pair of conductors. Thereafter, the bonded twisted pair 44' is fed onto an electrically driven take-up reel 48 whose take-up speed is variably controlled, to maintain a constant tension on the twisted pair, by a conventional dancer arm and level wind assembly 50. The resultant twisted pair can either be taken directly from the take-up reel 48 and used, or can be subjected to further process steps whereby a further dielectric layer 26, shield 28, and outer jacket 30 are added in a conventional manner.

The twisting step can be eliminated entirely if a straight, parallel conductor pair is desired, in which case the outer dielectric layers can be forcibly abutted against each other by suitable guides, such as opposed grooved pulleys or the like, inside the oven 46. Also, as an alternative to the oven 46, bonding of the outer dielectric layers to each other could be accomplished by passing the pair of conductors through a bath composed of a solvent or adhesive which is compatible with the outer dielectric layers but not with the inner dielectric layers so that the inner dielectric layers are not altered by the solvent or adhesive, just as their higher melting point prevents their alteration when passed through the oven 46.

A specific example of manufacturing a twisted conductor pair, having the exemplary dimensions and compositions described above with respect to the embodiment of FIG. 1, includes twisting the two conductors with a lay length of 0.50 inch and then heat-bonding the outer dielectric layers to each other by passing the twisted pair through a vertical oven 46, having a length of 38 inches and a temperature of about 375° F., at the rate of 8.8 feet per minute. A vertical oven 46 is preferred because the vertical convection in the oven produces a radially symmetrical temperature gradient about the axis of the twisted pair so that the rate of heating of the outer dielectric layers is uniform.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for making a controlled-impedance transmission line comprising a pair of elongate electrical conductors extending generally in transversely separated, side-by-side relationship, said method comprising:

(a) forming a respective inner dielectric layer around each conductor of a pair of conductors separately;

(b) thereafter forming a respective outer dielectric layer around each of said inner dielectric layers separately, each outer dielectric layer of a respective conductor being of a different composition than that of the inner dielectric layer of the respective conductor;

(c) thereafter bonding the outer dielectric layer of one of said conductors to the outer dielectric layer of the other of said conductors in side-by-side relationship substantially without altering the inner dielectric layers of the conductors, thereby forming a controlled-impedance transmission line having a substantially uniform transverse spacing and dielectric constant between said conductors throughout the length of said transmission line.

2. The method of claim 1, including selecting a first composition for the outer dielectric layers which is susceptible to alteration by the bonding of step (c), and conversely selecting a second composition for the inner dielectric layers which is immune from alteration by the bonding of step (c).

3. A method for making a controlled-impedance transmission line comprising a pair of elongate electrical conductors extending generally in transversely separated, side-by-side relationship, said method comprising:

(a) forming a respective inner dielectric layer around each conductor of a pair of conductors separately;

(b) thereafter forming a respective outer dielectric layer around each of said inner dielectric layers separately, each outer dielectric layer of a respective conductor being of a different composition than that of the inner dielectric layer of the respective conductor;

(c) thereafter heating and thereby fusing together portions of the respective outer dielectric layers in side-by-side relationship substantially without altering the inner dielectric layers of the conductors, the respective inner dielectric layers being of a composition having a higher melting temperature than the composition of said outer dielectric layers.

4. The method of claim 1 wherein step (c) comprises forcibly abutting the respective outer dielectric layers against each other in side-by-side relationship.

5. A method for making a controlled-impedance transmission line comprising a pair of elongate electrical conductors extending generally in transversely separated, side-by-side relationship, said method comprising:

(a) forming a respective inner dielectric layer around each conductor of a pair of conductors separately;

(b) thereafter forming a respective outer dielectric layer around each of said inner dielectric layers separately, each outer dielectric layer of a respective conductor being of a different composition than that of the inner dielectric layer of the respective conductor;

(c) helically twisting said conductors together and thereby forcibly abutting the respective outer dielectric layers against each other in side-by-side relationship, and thereafter bonding said outer dielectric layers to each other substantially without altering the inner dielectric layers of the conductors.

6. A method for making a controlled-impedance transmission line comprising a pair of elongate electrical conductors extending generally in transversely separated, side-by-side relationship, said method comprising:

(a) forming a respective inner dielectric layer around each conductor of a pair of conductors separately;

(b) thereafter forming a respective outer dielectric layer around each of said inner dielectric layers separately, each outer dielectric layer of a respective conductor being of a different composition than that of the inner dielectric layer of the respective conductor;

(c) thereafter bonding the outer dielectric layer of one of said conductors to the outer dielectric layer of the other of said conductors in side-by-side relationship in a manner reducing the respective thicknesses of the respective outer dielectric layers, relative to their respective thicknesses as formed in step (b), in the region transversely separating said conductors substantially without altering the inner dielectric layers of the conductors.

7. A method for making a controlled-impedance transmission line comprising a pair of elongate electrical conductors extending generally in transversely separated, side-by-side relationship, said method comprising:

(a) forming a respective inner dielectric layer around each conductor of a pair of conductors separately;

(b) thereafter forming a respective outer dielectric layer around each of said inner dielectric layers separately, each outer dielectric layer of a respective conductor being of a different composition than that of the inner dielectric layer of the respective conductor;

(c) thereafter bonding the outer dielectric layer of one of said conductors to the outer dielectric layer of the other of said conductors in side-by-side relationship substantially without altering the inner dielectric layers of the conductors;

(d) forming a further dielectric layer around the bonded outer dielectric layers resulting from step (c), thereafter forming a conductive shield around said further dielectric layer, and forming an outer insulating jacket around said shield and penetrating said shield with said outer insulating jacket.

8. A controlled-impedance transmission line comprising a pair of elongate electrical conductors extending generally in transversely separated, side-by-side relationship, each of said conductors being surrounded by a respective inner dielectric layer and a respective outer dielectric layer, each inner and outer dielectric layer being applied to a respective one of said conductors independently of the other one of said conductors, each outer dielectric layer of a respective conductor being of a different composition than that of the inner dielectric layer of the respective conductor, and the outer dielectric layer of one of said conductors being joined by a bond to the outer dielectric layer of the other of said conductors in side-by-side relationship substantially without alteration of the respective inner dielectric layers of the conductors from their condition as applied to the respective conductors, so as to form a controlled-impedance transmission line having a substantially uniform transverse spacing and dielectric constant between said conductors throughout the length of said transmission line.

9. A controlled-impedance transmission line comprising a pair of elongate electrical conductors extending generally in transversely separated, side-by-side relationship, each of said conductors being surrounded by a respective inner dielectric layer and a respective outer dielectric layer, each inner and outer dielectric layer being applied to a respective one of said conductors independently of the other one of said conductors, each outer dielectric layer of a respective conductor being of a different composition than that of the inner dielectric layer of the respective conductor, and the outer dielectric layer of one of said conductors being joined by a bond to the outer dielectric layer of the other of said conductors in side-by-side relationship such that the respective outer dielectric layers are altered from their condition as applied to the respective conductors substantially without alteration of the respective inner dielectric layers of the conductors from their condition as applied to the respective conductors.

10. controlled-impedance transmission line comprising a pair of elongate electrical conductors extending generally in transversely separated, side-by-side relationship, each of said conductors being surrounded by a respective inner dielectric layer and a respective outer dielectric layer, each inner and outer dielectric layer being applied to a respective one of said conductors independently of the other one of said conductors, each outer dielectric layer of a respective conductor being of a different composition than that of the inner dielectric layer of the respective conductor, the respective outer dielectric layers being joined by a bond, formed by heating and resultant fusion of portions of the respective outer dielectric layers, in side-by-side relationship substantially without alteration of the respective inner dielectric layers of the conductors from their condition as applied to the respective conductors, said inner dielectric layers being of a composition having a higher melting temperature than the composition of said outer dielectric layers.

11. A controlled-impedance transmission line comprising a pair of elongate electrical conductors extending generally in transversely separated, side-by-side relationship, each of said conductors being surrounded by a respective inner dielectric layer and a respective outer dielectric layer, each inner and outer dielectric layer being applied to a respective one of said conductors independently of the other one of said conductors, each outer dielectric layer of a respective conductor being of a different composition than that of the inner dielectric layer of the respective conductor, and the outer dielectric layer of one of said conductors being joined by a bond to the outer dielectric layer of the other of said conductors in side-by-side relationship substantially without alteration of the respective inner dielectric layers of the conductors from their condition as applied to the respective conductors such that the respective outer dielectric layers of said conductors have respective thicknesses in the region transversely separating said conductors which are less than their thicknesses as applied to the respective conductors.

12. A controlled-impedance transmission line comprising a pair of elongate electrical conductors extending generally in transversely separated, side-by-side relationship, each of said conductors being surrounded by a respective inner dielectric layer and a respective outer dielectric layer, each inner and outer dielectric layer being applied to a respective one of said conductors independently of the other one of said conductors, each outer dielectric layer of a respective conductor being of a different composition than that of the inner dielectric layer of the respective conductor, and the outer dielectric layer of one of said conductors being joined by a bond to the outer dielectric layer of the other of said conductors in side-by-side relationship substantially without alteration of the respective inner dielectric layers of the conductors from their condition as applied to the respective conductors, said conductors being held in a helically twisted relationship to each other by said bond.

13. A controlled-impedance transmission line comprising a pair of elongate electrical conductors extending generally in transversely separated, side-by-side relationship, each of said conductors being surrounded by a respective inner dielectric layer and a respective outer dielectric layer, each inner and outer dielectric layer being applied to a respective one of said conductors independently of the other one of said conductors, each outer dielectric layer of a respective conductor being of a different composition than that of the inner dielectric layer of the respective conductor, and the outer dielectric layer of one of said conductors being joined by a bond to the outer dielectric layer of the other of said conductors in side-by-side relationship substantially without alteration of the respective inner dielectric layers of the conductors from their condition as applied to the respective conductors, a further dielectric layer surrounding the respective outer dielectric layers, a conductive shield surrounding said further dielectric layer, and an outer insulating jacket around said shield which penetrates said shield.

* * * * *

UNITED STATES PATENT AND TRADEMARK OFFICE

CERTIFICATE OF CORRECTION

PATENT NO. : 5,015,800

DATED : May 14, 1991

INVENTOR(S) : Gregory P. Vaupotic et al.

It is certified that error appears in the above-identified patent and that said Letters Patent is hereby corrected as shown below:

Col. 1, line 46, Change "are" to --area--;

Col. 2, line 4 Change "an" to --and--;

Col. 9, line 8 Insert --A-- before "controlled-impedance"

Signed and Sealed this

Third Day of November, 1992

*Attest:*

DOUGLAS B. COMER

*Attesting Officer*

*Acting Commissioner of Patents and Trademarks*